US011998093B2

(12) United States Patent
Lee

(10) Patent No.: US 11,998,093 B2
(45) Date of Patent: Jun. 4, 2024

(54) DUAL-PURPOSE STICK FOR SITTING AND WALKING

(71) Applicant: Ming-Hsien Lee, Taichuang (TW)

(72) Inventor: Ming-Hsien Lee, Taichuang (TW)

( * ) Notice: Subject to any disclaimer, the term of this patent is extended or adjusted under 35 U.S.C. 154(b) by 177 days.

(21) Appl. No.: 17/875,401

(22) Filed: Jul. 27, 2022

(65) Prior Publication Data

US 2024/0016266 A1 Jan. 18, 2024

(30) Foreign Application Priority Data

Jul. 14, 2022 (CN) ..... 202210827358.6

(51) Int. Cl.

| | |
|---|---|
| ***A45B 5/00*** | (2006.01) |
| ***A45B 9/02*** | (2006.01) |
| ***A47C 9/10*** | (2006.01) |
| ***A47C 13/00*** | (2006.01) |
| *A45B 9/00* | (2006.01) |

(52) U.S. Cl.

CPC ..... *A45B 5/00* (2013.01); *A45B 9/02* (2013.01); *A47C 9/10* (2013.01); *A47C 13/00* (2013.01); *A45B 2009/005* (2013.01)

(58) Field of Classification Search

CPC ..... A45B 5/00; A47C 13/00; A47C 9/10

USPC ..... 135/66; 297/4, 195.11

See application file for complete search history.

(56) References Cited

U.S. PATENT DOCUMENTS

| | | | | | |
|---|---|---|---|---|---|
| 280,843 | A * | 7/1883 | McGaughey | A45B 5/00 | 248/155.1 |
| 444,621 | A * | 1/1891 | Schneider | A45B 5/00 | 135/66 |
| 504,326 | A * | 9/1893 | Chapman | A45B 5/00 | 135/66 |
| 690,122 | A * | 12/1901 | Slagle | A47C 9/025 | 297/4 |
| 731,437 | A * | 6/1903 | Czermak et al. | A45B 5/00 | 135/66 |
| 787,166 | A * | 4/1905 | Garden | A45B 5/00 | 248/155.1 |
| D113,534 | S * | 2/1939 | Bodkin | D3/7 | |
| 4,641,882 | A * | 2/1987 | Young | A47C 9/025 | 297/195.11 |
| 4,700,914 | A * | 10/1987 | Cheetham | A45B 5/00 | 108/150 |
| D299,189 | S * | 1/1989 | Large | D6/335 | |
| D308,439 | S * | 6/1990 | Van Winkle | D3/7 | |

(Continued)

*Primary Examiner* — Robert Canfield

(74) *Attorney, Agent, or Firm* — Birchwood IP

(57) ABSTRACT

A dual-purpose stick for sitting and walking, comprising a stick body with a fixed inserting hole and an elongated hole; a seat-grip cushion body with a grip portion, a cushion portion and a grip hole, the cushion portion is axially extends axially with a pivot slot, the pivot slot comprises a vertical inserting hole in a axial direction and a horizontal inserting hole in a radial direction, a pivot inserting hole is radially penetrated on an outer surface of the seat cushion portion; an elastic element, arranged in the stick body; a fixing element, inserted into the fixed inserting hole and connected with bottom end of the elastic element; a penetrating element, inserted into the pivot hole and the elongated hole, connected with top end of the elastic element. The seat-grip cushion body can be movably pivoted and positioned between an upright grip position and a horizontal seat cushion position.

10 Claims, 10 Drawing Sheets

(56) References Cited

U.S. PATENT DOCUMENTS

| | | | | |
|---|---|---|---|---|
| 5,927,797 | A * | 7/1999 | Ferguson | A47C 9/025 297/4 |
| 6,062,638 | A * | 5/2000 | Ferguson | A47C 9/025 297/4 |
| 7,316,449 | B2 * | 1/2008 | Lynch | A61H 3/02 248/155.2 |
| 8,403,408 | B2 * | 3/2013 | Hosler | A47C 9/025 297/4 |
| 2005/0242630 | A1 * | 11/2005 | Miller | A45F 5/02 297/4 |
| 2008/0007098 | A1 * | 1/2008 | Girard | B62J 1/08 297/195.1 |

* cited by examiner

DUAL-PURPOSE STICK FOR SITTING AND WALKING

CROSS-REFERENCE TO RELATED APPLICATIONS

This application claims the benefit and priority of Chinese patent application No. 202210827358.6, filed on Jul. 14, 2022, disclosure of which is hereby incorporated by reference in its entirety.

TECHNICAL FIELD

The present application relates to the technical field of mobility aids, in particular to a dual-purpose stick for sitting and walking.

BACKGROUND

Whether it is an ordinary person, an elderly person or a person with a slight mobility problem, they may carry crutches, trekking sticks, walking sticks or umbrellas as support equipment when walking to achieve the function of saving effort.

However, implements such as crutches, trekking poles, walking sticks or umbrellas are only intended to provide support while walking. Crutches, trekking poles, walking sticks or umbrellas are useless if the user wants to sit down and rest while walking halfway. As a result, the user can only borrow a seat from a nearby business, or find out whether there is an object to sit on the roadside, but it is usually not easy to find an object to sit on, so that the user cannot get a rest immediately.

SUMMARY

In view of this, in order to solve the problem in the prior art that the conventional stick can only provide support for walking, but cannot provide sitting, the present application provides a dual-purpose stick for sitting and walking, which comprises a stick body, a fixed inserting hole and an elongated hole radially penetrate through top outer peripheral surface of the stick body, the elongated hole is axially extended and located above the fixed inserting hole; a seat-grip cushion body, comprises a grip portion at one end and a seat cushion portion connected to the grip portion at the other end, wherein a grip hole is formed between the grip portion and the seat cushion portion, a free end of the seat cushion portion axially extends inward with a pivoting slot, a through-through vertical inserting hole extends axially inside the seat cushion portion and at the end position where the pivot slot extends, and a through-through horizontal inserting hole extends inside the seat cushion portion and in the radial direction of the pivot slot, wherein one side of the pivoting slot is an open pivoting opening, and a pivoting inserting hole that communicates with the pivoting slot is radially penetrated through an outer surface of the seat cushion portion; an elastic element, arranged in the stick body; a fixing element, inserted into the fixed inserting hole and connected with bottom end of the elastic element; a penetrating element, the top of the stick body is inserted into the pivoting slot of the seat-grip cushion body, wherein the penetrating element is inserted into the pivot slot of the seat-grip cushion body and the elongated hole of the stick body, and is connected with the top end of the elastic element, so that the penetrating element can be displaced in the elongated hole, the elastic element provides the seat-grip cushion body with an elastic force to move in the direction of the stick body, so that the seat-grip cushion body can be movably pivoted and positioned relative to the stick body between an upright grip position and a horizontal seat cushion position under the action of external force; when the seat-grip cushion body is in the grip position, the top of the stick body is inserted into the vertical inserting hole; when the seat-grip cushion body is in the seat cushion position, the top of the stick body is inserted into the horizontal inserting hole. Therefore, the user can be supported while walking, and the function of temporarily sitting down can be provided for the user.

Figure 1:
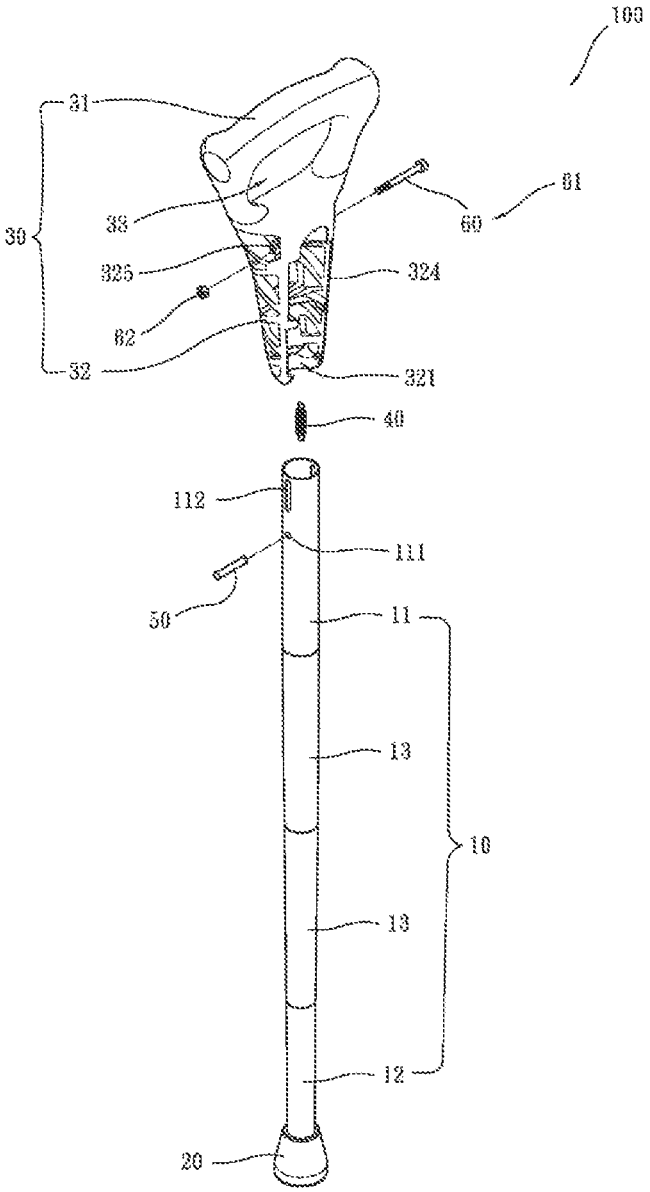
FIG. 1 is an exploded perspective view of a preferred embodiment according to the present invention.

| Reference signs: | | | |
|---|---|---|---|
| Stich for sitting and walking | 100 | | |
| Top tube | 11 | Fixed inserting hole | 111 |
| Elongated hole | 112 | Bottom tube | 12 |
| Base | 20 | | |
| Seat-grip cushion body | 30 | | |
| Grip Portion | 31 | Seat cushion portion | 32 |
| Horizontal inserting hole | 323 | Pivoting opening | 324 |
| Pivoting inserting hole | 325 | Grip hole | 33 |
| Elastic element | 40 | | |
| Fixing element | 50 | | |
| Penetrating element | 60 | | |
| Bolt | 61 | Nut | 62 |
| Noose | 70 | | |

DETAILED DESCRIPTION

Figure 2:
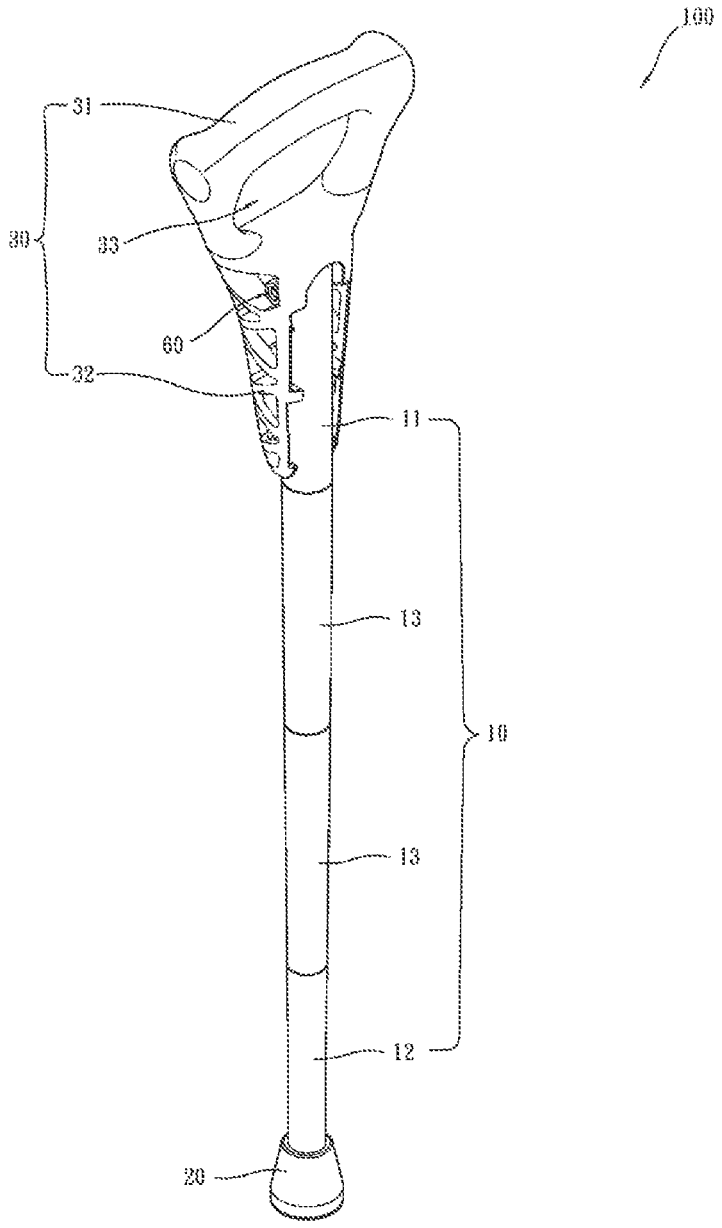
FIG. 2 is a three-dimensional combined view of the embodiment shown in FIG. 1.

In order to enable the Examiner to have a further understanding and recognition of the features and characteristics of this application, the following embodiments are listed and described with the drawings as follows:

Please refer to FIGS. 1 to 7, which is a stick for sitting and walking 100 provided by a preferred embodiment of the present application, which mainly comprises a stick body 10, a base 20, a seat and grip cushion body 30, an elastic element 40, a fixing portion 50 and a penetrating portion 60, wherein:

Please refer to FIG. 1 and FIG. 2, the stick body 10 is formed by a plurality of tube bodies being sleeved together along the same axis direction. The stick body 10 comprises a top tube 11, a bottom tube 12 and a plurality of middle tubes 13 detachably sleeved along the same axis direction between the top tube 11 and the bottom tube 12. The top tube 11 is located at the top of the entire stick body 10, a fixed inserting hole 111 penetrates radially (i.e. laterally) on the outer peripheral surface of the top tube 11, and an elongated hole 12 extends radially (i.e. transversely) through the outer peripheral surface of the top tube 11. The elongated hole 112 extends axially and is located above the fixed inserting hole 111.

Please refer to FIG. 1 and FIG. 2, the base 20 is connected to the bottom end of the bottom tube 12 of the stick body 10, and the base 20 has appropriate elasticity.

Figure 3:
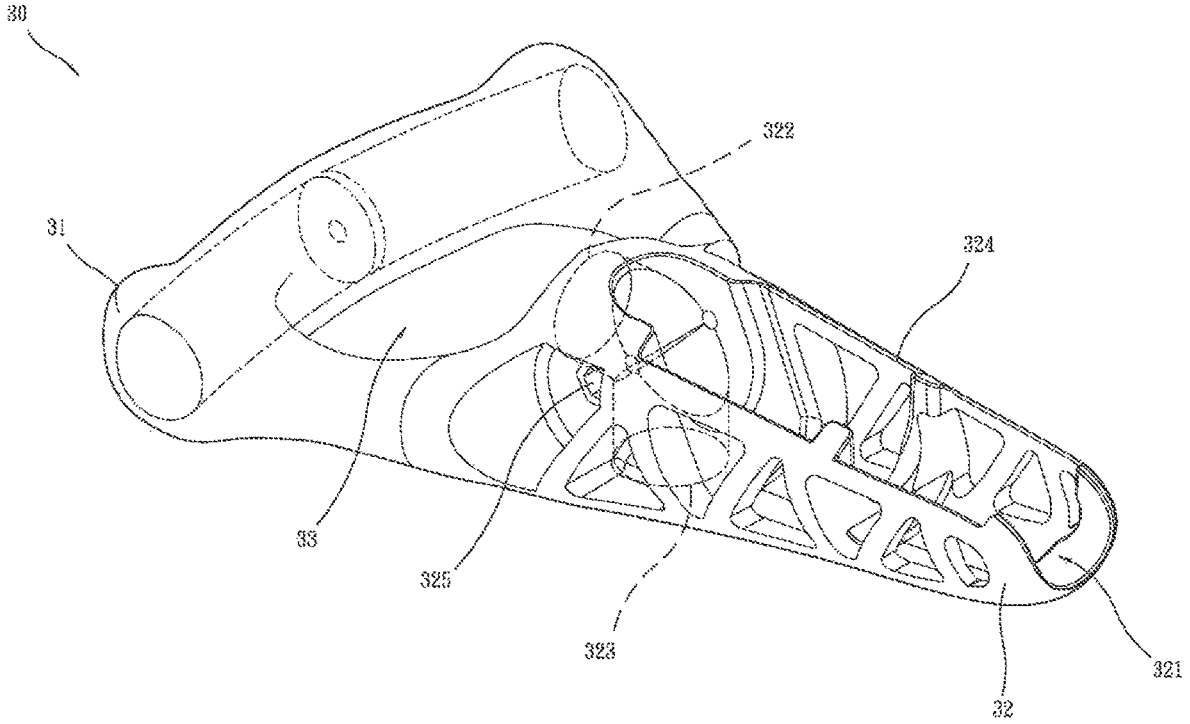
FIG. 3 is a schematic perspective view of a portion of the components of the embodiment shown in FIG. 1.

Please refer to FIG. 1 to FIG. 3, the seat-grip cushion body 30 is made in one piece. The seat-grip cushion body 30 comprises a grip portion 31 at one end and a seat cushion portion 32 connected to the grip portion 31 at the other end. A grip hole 33 is formed between the grip portion 31 and the seat cushion portion 32, and the grip hole 33 can allow the fingers of the human body to pass through and grasp the grip portion 31 by the palm of the hand. A free end of the seat cushion portion 32 axially extends inward with a pivoting slot 321, a vertical inserting hole 322 extends axially inside the seat cushion portion 32 and at the end position where the pivot slot 321 extends, and the vertical inserting hole 322 is in axial communication with the pivot slot 321. A horizontal inserting hole extends inside the seat cushion portion and in the radial direction of the pivot slot, and the horizontal inserting hole 323 is in radial communication with the pivot slot 321. One side of the pivoting slot 321 is an open pivoting opening 324, the side of the pivot slot 321 is communicated with the outside through the pivoting opening 324. A pivoting inserting hole 325 that communicates with the pivoting slot 321 is radially penetrated through an outer surface of the seat cushion portion 32.

Please refer to FIG. 1 and FIGS. 4 to 6, the elastic element 40 is an extension spring. The elastic element 40 is placed in the top tube 11 of the stick body 10.

Please refer to FIG. 1 and FIGS. 4 to 6, the fixing element 50 is a latch. The fixing element 50 is inserted into the fixed inserting hole 111 of the stick body 10 and is connected with the bottom end of the elastic element 40 (i.e., the fixing element 50 passes through the bottom end of the elastic element 40).

Please refer to FIG. 1, FIG. 2 and FIGS. 4 to 6, the penetrating element 60 is a combination of a bolt 61 and a nut 62. The top tube 11 of the stick body 10 is inserted into the pivot slot 321 of the seat-grip cushion body 30, and the penetrating element 60 is penetrated into the pivoting inserting hole 325 of the seat-grip cushion body 30 and the elongated hole 112 of the stick body 10, and is connected with the top end of the elastic element 40 (i.e., the penetrating element 60 passes through the top end of the elastic element 40). The stick body 10 and the seat-grip cushion body 30 are movably connected through the penetrating element 60, so that the seat-grip cushion body 30 can movably pivot relative to the stick body 10 from a grip position to a seat cushion position.

Figure 4:
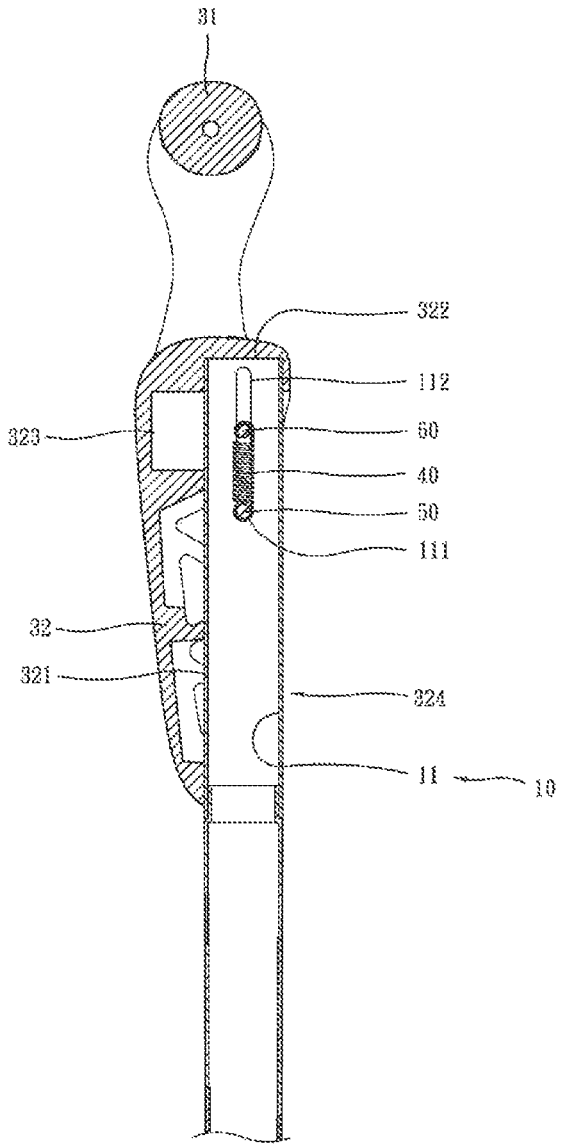
FIG. 4 to 7 are schematic views of the operation of the embodiment shown in FIG. 1.

Therefore, the above is the introduction of each component of a stick for sitting and walking 100 and its assembly method provided by a preferred embodiment of the present application, and then its use characteristics are introduced as follows:

When you want to use this application as a walking stick, as shown in FIGS. 2 and 4. First, pivot the seat-grip cushion body 30 to be upright. The elastic element 40 provides a pulling force, and the seat-grip cushion body 30 is pulled toward the stick body 10, so that the top end of the top tube 11 of the stick body 10 is inserted into the vertical inserting hole 322 of the seat-grip cushion body 30 (As shown in FIG. 4), so that the seat-grip cushion body 30 is upright at this time and is fixed in the grip position. At this time, the user's fingers can pass through the grip hole 33 of the seat-grip cushion body 30, and the palm can be grasped on the grip portion 31 of the seat-grip cushion body 30, so that the application can be used as a walking stick.

Figure 5:
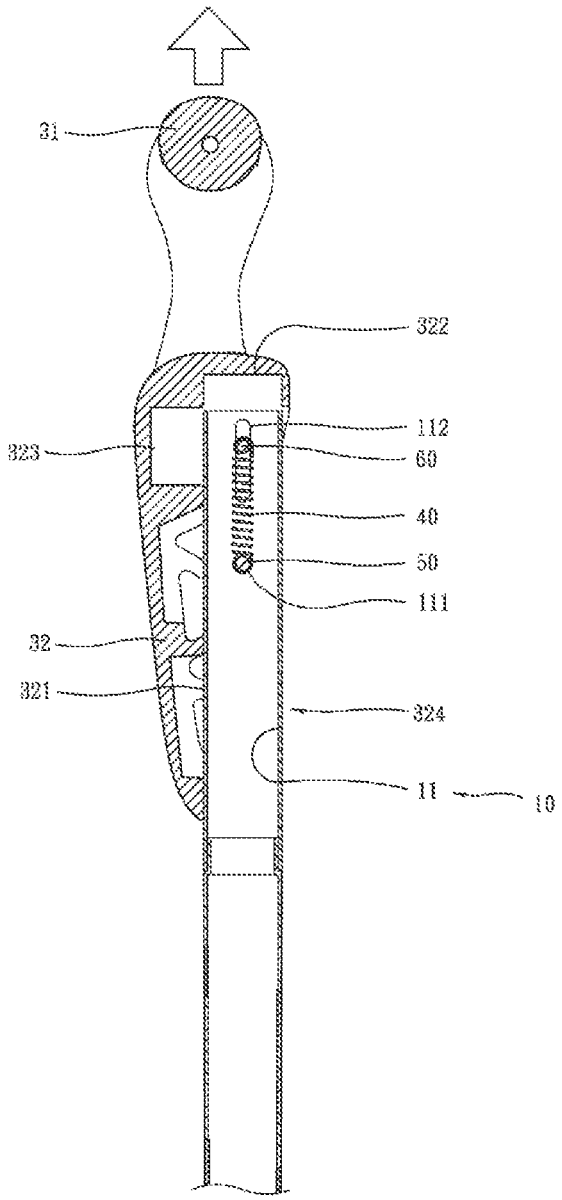
Figure 6:
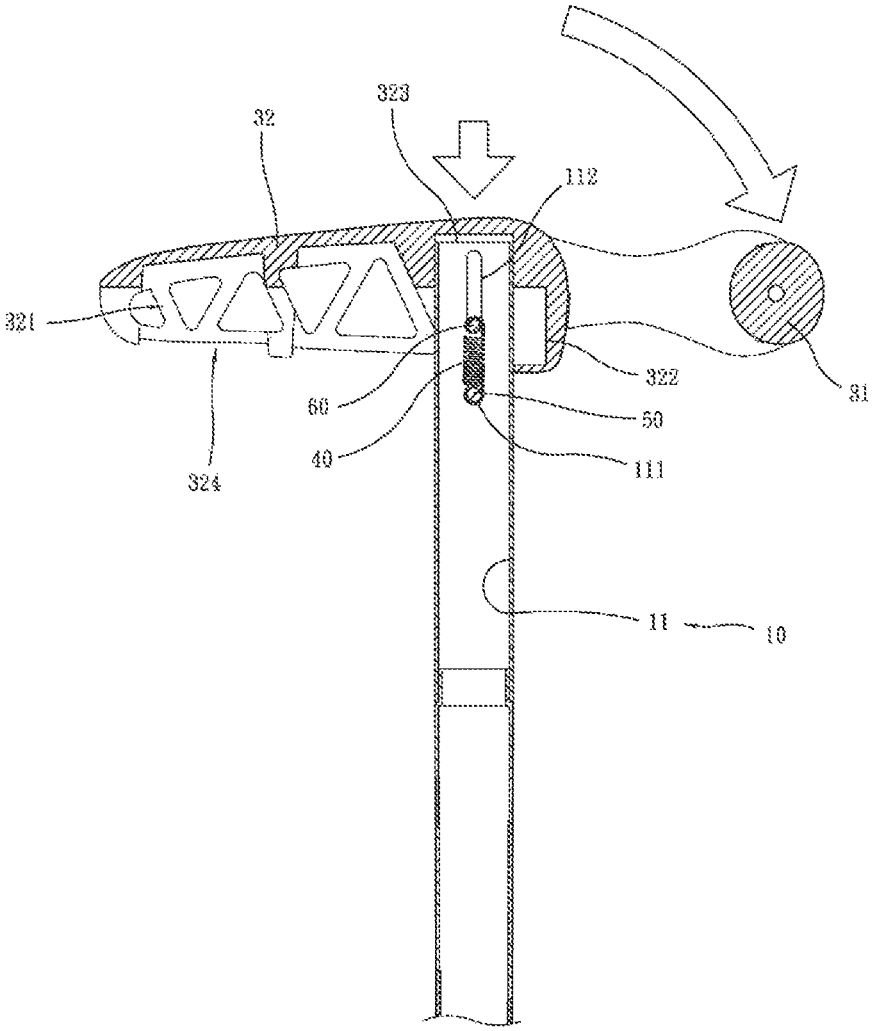
Figure 7:
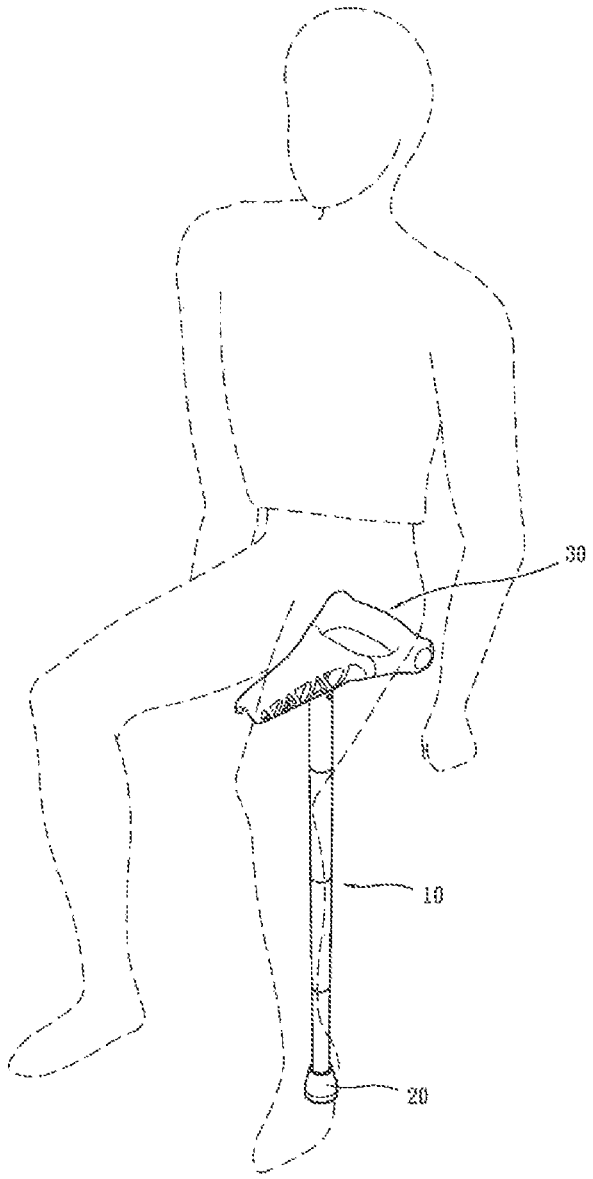

When the user needs to take a break after walking outside for a period of time, he can pull up the seat-grip cushion body 30 (or pull down the stick body) with a little force, so that the penetrating element 60 is moved upward in the elongated hole 12, so that the top tube 11 of the stick body 10 is released from the vertical inserting hole 322 (as shown in FIG. 5). Then, the seat-grip cushion body 30 can be rotated by 90 degrees (the vertical inserting hole and the horizontal inserting hole are at a 90 degree angle), so that the top tube 111 of the stick body 10 corresponds to the horizontal inserting hole 323 of the seat-grip cushion body 30 at this time (as shown in FIG. 6). Then release the seat-grip cushion body 30, so that the elastic element 40 provides the seat-grip cushion body 30 with elastic force to move in the direction of the stick body 10, and the top end of the top tube 11 of the stick body 10 is inserted into the horizontal inserting hole 323 of the seat-grip cushion body 30, so that the seat-grip cushion body 30 is horizontal and fixed at the seat cushion position Thereby, the user's buttocks sit on the seat-grip cushion body 30 which is horizontal and fixed on the seat cushion position (as shown in FIG. 7), and is supported on the ground by the stick body 10.

Therefore, since the seat-grip cushion body 30 of the present application can be easily pulled, turned, and released, the shape can be converted and fixed from the upright grip position to the horizontal seat cushion position. Therefore, it can be used as a walking stick or as a temporary seat, which greatly increases the scope of application of this creation and improves the convenience of use, thereby increasing the competitiveness in the market.

Figure 8:
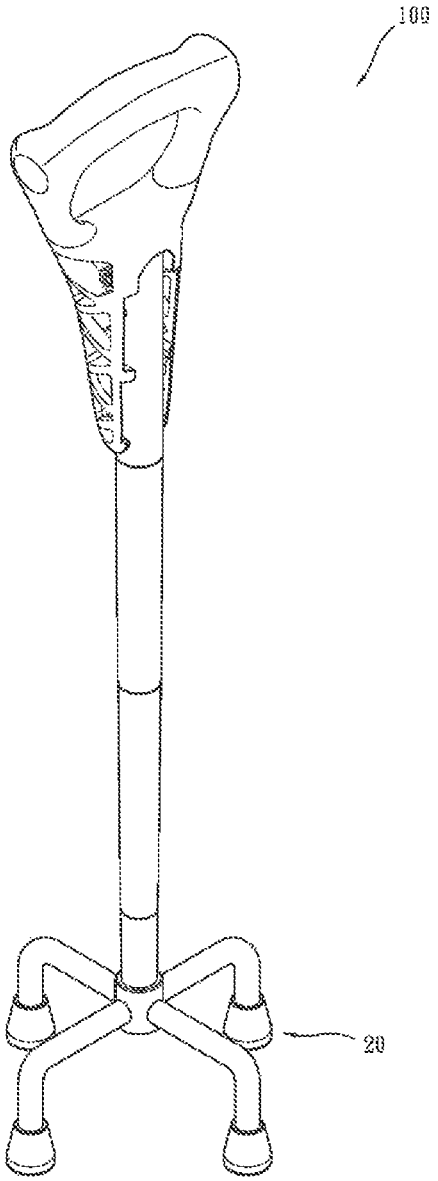
FIG. 8 is a three-dimensional combined view of another embodiment provided by the present application.

In addition, although in the above-mentioned embodiment, the base 20 is presented in the form of a single column. However, in fact, as shown in FIG. 8, the base 20 can also be presented in a multi-column shape, which can increase the support during walking and sitting.

Figure 9:
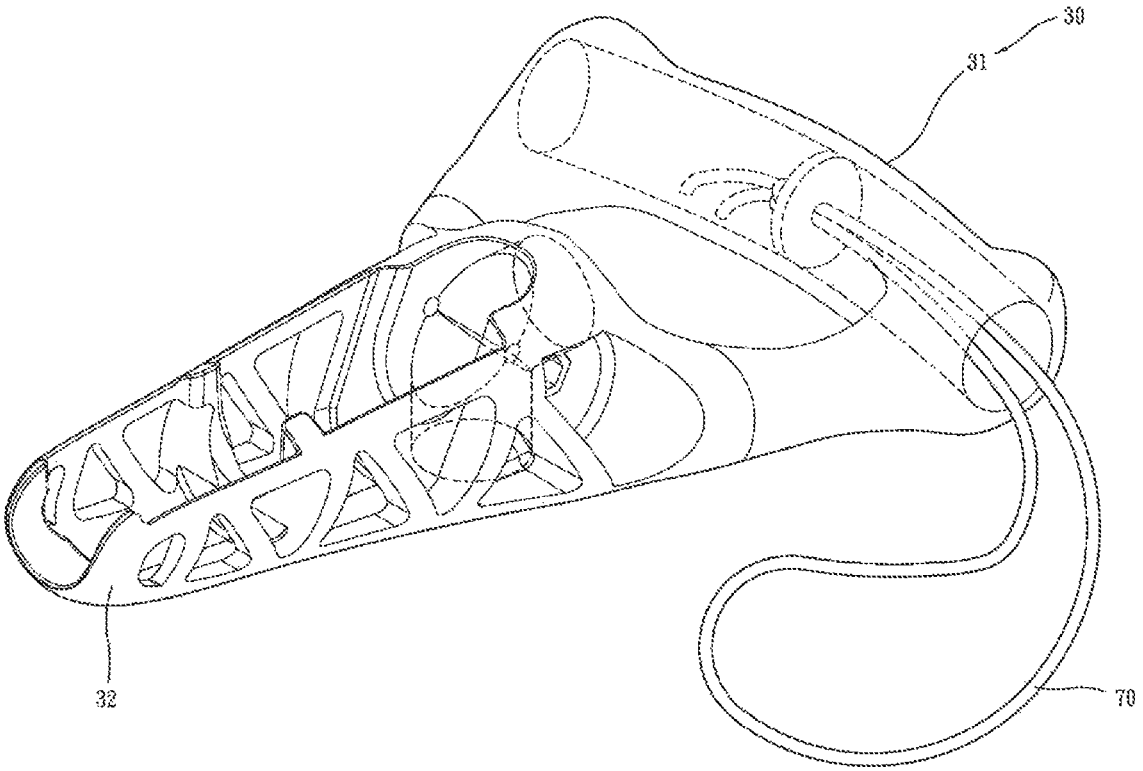
FIG. 9 is a schematic perspective view of a partially component of another embodiment according the present application.

Secondly, the present application may further comprise a noose 70, as shown in FIG. 9, the noose 70 is combined with the grip portion 31 of the seat-grip cushion body 30 and partially exposed to the outside for the user to use It can be penetrated by the hand, and the noose is provided for the user's hand to fit in, which can prevent the user's hand from slipping off.

Figure 10:
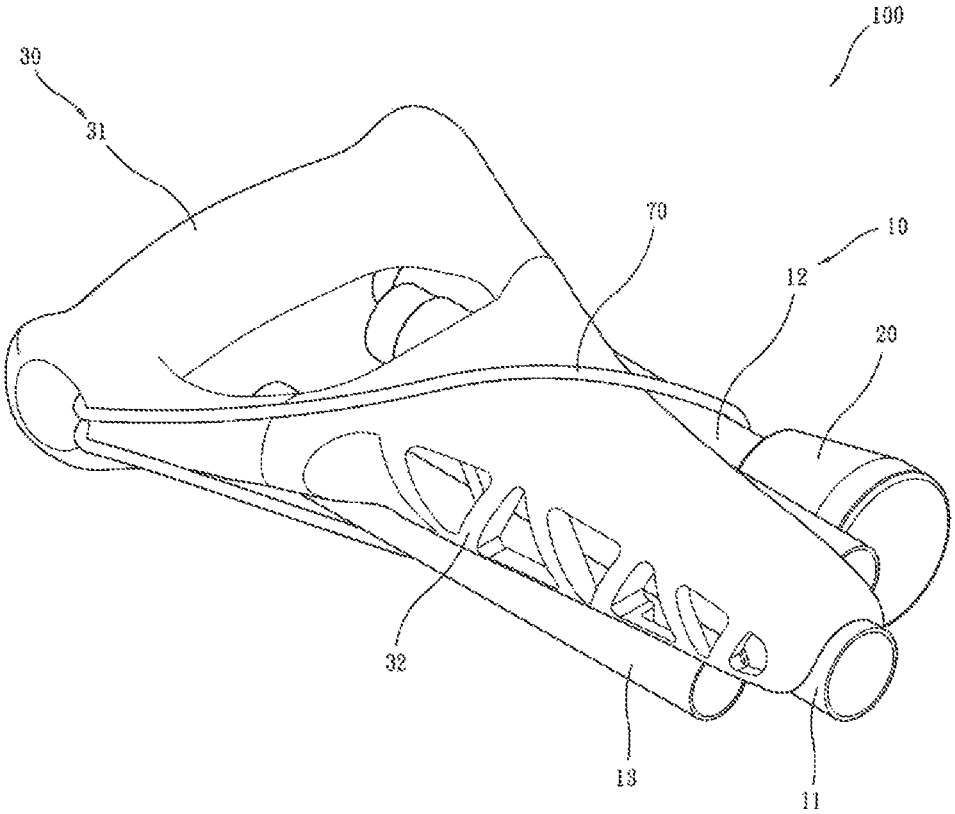
FIG. 10 is a schematic diagram of the operation of the embodiment shown in FIG. 9.

Furthermore, in the above-mentioned embodiment, the stick body 10 is formed by sleeved connection of the top tube 11, the bottom tube 12 and the middle tube 13. Therefore, after the user goes home or wants to go out, the stick body 10 can also be detached, and the noose 70 is fastened on the top tube 11, the bottom tube 12 and the middle tube 13 (as shown in FIG. 10), in order to reduce the length and facilitate storage at home or in a bag, which can improve the convenience of the present application.

In particular, in order to prevent the detached top tube, bottom tube and middle tube from being scattered, a rope body (not shown in FIGS.) can also be arranged inside the stick body to prevent the top tube, bottom tube and middle tube from being scattered.

The above disclosure is only a preferred embodiment provided by this application, and is not intended to limit the scope of implementation of this application. All the equivalent changes made by those skilled in the art according to this application shall belong to the scope covered by this application.

What is claimed is:

1. A dual-purpose stick for sitting and walking, comprising a stick body, a fixed inserting hole and an elongated hole radially penetrate through top outer peripheral surface of the stick body, the elongated hole is axially extended and located above the fixed inserting hole;

a seat-grip cushion body, comprises a grip portion at one end and a seat cushion portion connected to the grip portion at the other end, wherein a grip hole is formed between the grip portion and the seat cushion portion, a free end of the seat cushion portion axially extends inward with a pivoting slot, a vertical inserting hole extends axially inside the seat cushion portion and at an end position where the pivoting slot extends, and a horizontal inserting hole extends inside the seat cushion portion and in a radial direction of the pivoting slot, wherein one side of the pivoting slot is an open pivoting opening, and a pivoting inserting hole that communicates with the pivoting slot is radially penetrated through an outer surface of the seat cushion portion;

an elastic element, arranged in the stick body;

a fixing element, inserted into the fixed inserting hole and connected with a bottom end of the elastic element;

a penetrating element, the top of the stick body is inserted into the pivoting slot of the seat-grip cushion body, wherein the penetrating element is inserted into the pivoting slot of the seat-grip cushion body and the elongated hole of the stick body, and is connected with the top end of the elastic element, so that the penetrating element can be displaced in the elongated hole, the elastic element provides the seat-grip cushion body with an elastic force to move in the direction of the stick body, so that the seat-grip cushion body can be movably pivoted and positioned relative to the stick body between an upright grip position and a horizontal seat cushion position under the action of external force;

when the seat-grip cushion body is in the grip position, the top of the stick body is inserted into the vertical inserting hole, when the seat-grip cushion body is in the seat cushion position, the top of the stick body is inserted into the horizontal inserting hole.

2. The dual-purpose stick for sitting and walking according to claim 1, wherein the stick body comprises a top tube, a bottom tube and a plurality of middle tubes detachably sleeved along the same axis direction between the top tube and the bottom tube, the fixed inserting hole and the elongated hole radially penetrate an outer peripheral surface of the top tube; the elastic element is placed in the top tube.

3. The dual-purpose stick for sitting and walking according to claim 1, wherein further comprising a base, and the base is connected to the bottom end of the stick body.

4. The dual-purpose stick for sitting and walking according to claim 3, wherein the base is in the form of a single column.

5. The dual-purpose stick for sitting and walking according to claim 3, wherein the base is in a multi-column shape.

6. The dual-purpose stick for sitting and walking according to claim 1, wherein the elastic element is an extension spring.

7. The dual-purpose stick for sitting and walking according to claim 1, wherein the fixing element is a latch.

8. The dual-purpose stick for sitting and walking according to claim 1, wherein the penetrating element is a combination of a bolt and a nut.

9. The dual-purpose stick for sitting and walking according to claim 1, wherein an included angle of 90 degrees is formed between the vertical inserting hole and the horizontal inserting hole.

10. The dual-purpose stick for sitting and walking according to claim 1, wherein further comprising a noose, the noose is connected to the grip portion of the seat-grip cushion portion and partially exposed to the outside.

* * * * *